US005568738A

United States Patent [19]

Wang

[11] Patent Number: 5,568,738

[45] Date of Patent: Oct. 29, 1996

[54] NEEDLE SELECTION DEVICE OF A CIRCULAR KNITTING MACHINE

[75] Inventor: Ping-Shin Wang, Taipei, Taiwan

[73] Assignee: Pai Lung Machinery Mill Co., Ltd., Taipei, Taiwan

[21] Appl. No.: 563,341

[22] Filed: Nov. 28, 1995

[51] Int. Cl.[6] ..... D04B 15/78; D04B 9/38

[52] U.S. Cl. ..... 66/222; 66/219; 66/221

[58] Field of Search ..... 66/218, 219, 220, 66/221, 222

[56] References Cited

U.S. PATENT DOCUMENTS

| | | | |
|---|---|---|---|
| 2,025,464 | 12/1935 | Lombardi | 66/222 X |
| 3,678,710 | 7/1972 | Gostelow | 66/222 X |
| 3,948,062 | 4/1976 | Sumitomo | 66/220 X |
| 3,972,206 | 8/1976 | Mureso | 66/219 |
| 4,827,740 | 5/1989 | Cottenceau et al. | 66/219 X |
| 5,174,131 | 12/1992 | Cottenceau et al. | 66/219 X |

FOREIGN PATENT DOCUMENTS

| | | | |
|---|---|---|---|
| 2318377 | 10/1974 | Germany | 66/219 |
| 1254980 | 5/1974 | United Kingdom | 66/219 |

*Primary Examiner*—John J. Calvert
*Attorney, Agent, or Firm*—Bacon & Thomas

[57] ABSTRACT

A needle selection device including a plurality of push jacks respectively mounted in the needle slots of the needle cylinder of a circular knitting machine, a plurality of lifting bars respectively mounted in the needle slots and selectively driven by the push jacks to lift respective needles, and an electromagnetic device mounted on the cam of the circular knitting machine and moved by it to pass from one lifting bar to another, wherein each lifting bar is balanced in one needle slot on a fulcrum at its center and moved by the electromagnetic device between a first position in which the lifting bar will be driven by the respective push jack to lift the respective needle, and a second position in which the lifting bar will not be driven by the respective push jack to lift the respective needle.

1 Claim, 5 Drawing Sheets

NEEDLE SELECTION DEVICE OF A CIRCULAR KNITTING MACHINE

BACKGROUND OF THE INVENTION

The present invention relates to a needle selection device, and relates more specifically to such a needle selection device installed in a circular knitting machine and controlled to selectively lift the needles.

Various devices have been disclosed for selective raising of the needles in circular knitting machines for knitting different pattern works. U.S. Pat. No. 4,604,877, entitled "NEEDLE SELECTION DEVICE FOR KNITTING MACHINES" shows a device including a pair of side-by-side stacks of selector slides or cams supported for individual horizontal sliding movement between innermost active and outermost inactive radial positions. This structure of needle selection device does not allow the user to change the needle selection mode during the knitting of the machine. U.S. Pat. Nos. 4,799,366 and 4,023,383 teach the use of a stationary electromagnetic actuator for acting by magnetic attraction on wire springs incorporated inside selection sinkers inserted inside the slots under the needles and the needle pushers. The disadvantage of this structure of needle selection system is that the wire springs will wear out quickly with use. U.S. Pat. Nos. 3,948,062 and 4,793,159 disclose an electronic means for selective raising of the needles in circular knitting machines by the selective raising of jacks individually related to the needles in the cylinder needle slots. However, this electronic means is acted with a complicated lever action structure.

SUMMARY OF THE INVENTION

The present invention has been accomplished to provide a needle selection device which eliminates the aforesaid drawbacks. According to the present invention, push jacks and lifting bars are respectively mounted in the needle slots of a circular knitting machine, and an electromagnetic device is controlled to move each lifting bar between the active position and the inactive position for selective raising of the needles. The electromagnetic device simply comprises two electromagnets disposed at different elevations and controlled to move each lifting bar between the active position and the inactive position.

DETAILED DESCRIPTION OF THE PREFERRED EMBODIMENT

Figure 3:
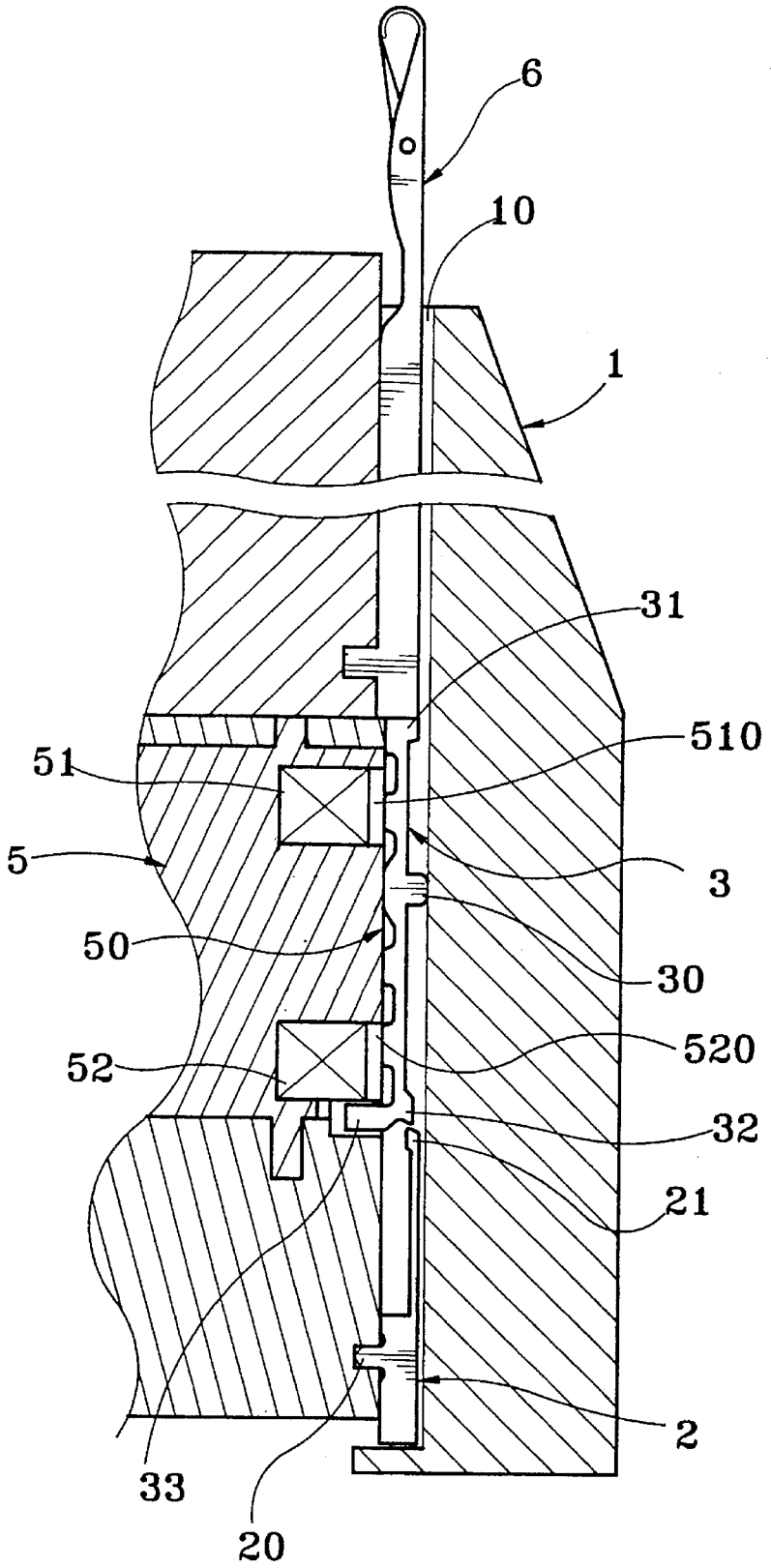
FIG. 3 is a sectional view along line III—III of FIG. 6.
Figure 6:
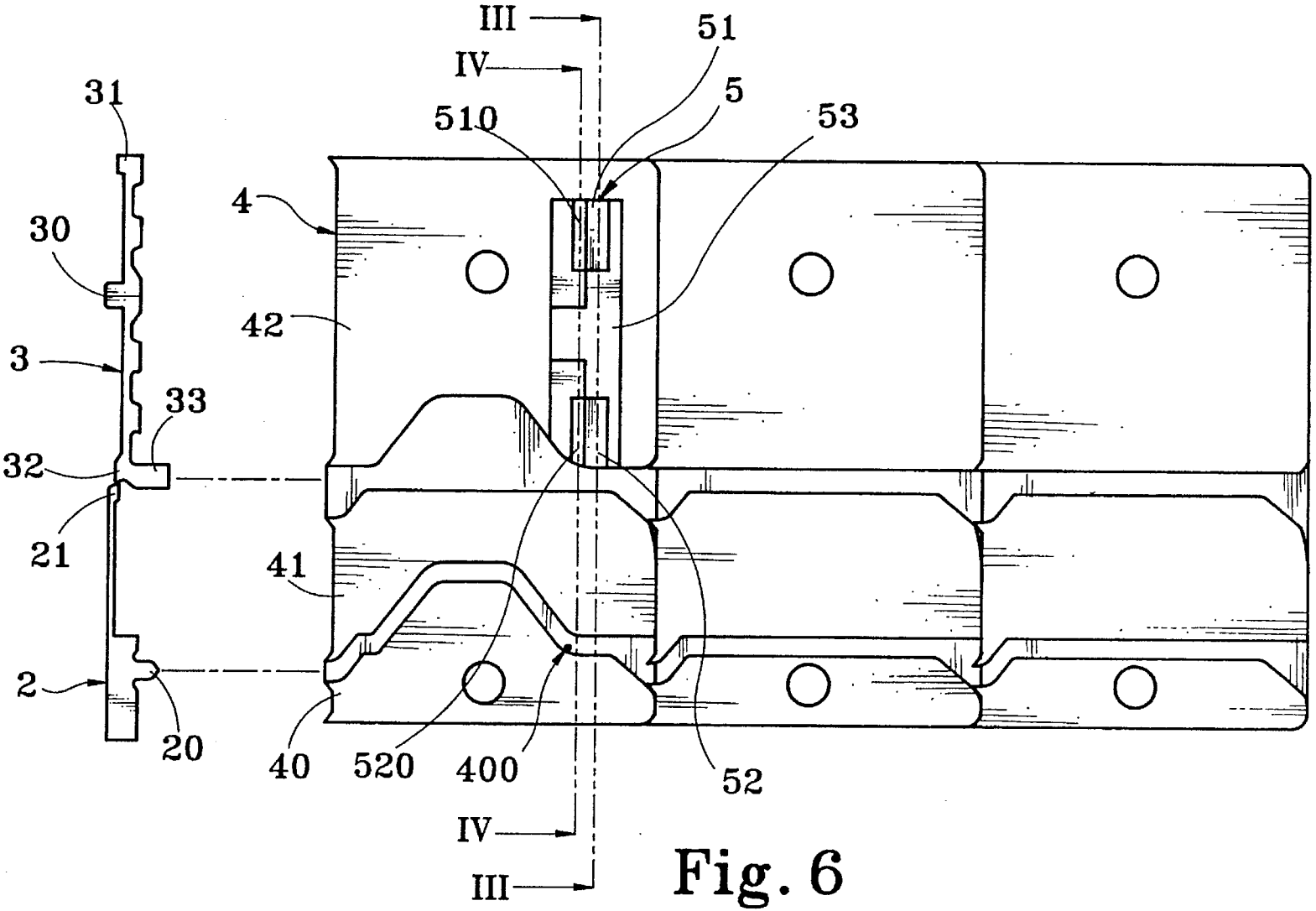
FIG. 6 shows the relative positions between the push jack, the lifting bar, the electromagnetic device, and the cam of the circular knitting machine according to the present invention.

Referring to FIGS. 3 and 6, a needle selection device in accordance with the present invention comprises a push jack 2 and a lifting bar 3 mounted in each needle slot 10 of the needle cylinder 1 of a circular knitting machine, and an electromagnetic device 5 mounted on the cam 4 of the knitting machine and moved by it from one needle slot 10 to another.

The push jack 2 comprises a butt 20 and a nose 21. The butt 20 is disposed in between the bottom needle lifting section 40 and the bottom needle pulling section 41 of the cam 4, and moved along the curved top side of the bottom needle lifting section 40 to lift the needle 6 or forced by the bottom needle pulling section 41 to retract the needle 6. The curvature of the curved top side of the bottom needle lifting section 40 is designed subject to the pattern of the fabric to be made for lifting the needle 6 to the knitting position. On the contrary, when the butt 20 is disposed at the flat surface portion of the bottom needle lifting section 40, the push jack 2 keeps the needle 6 in the idle course. The lifting bar 3 and the push jack 2 are mounted in the same needle slot 10, however the lifting bar 3 is disposed between the needle 6 and the push jack 2, and controlled to transfer the lifting force of the push jack 2 to the needle 6. The lifting bar 3 comprises a fulcrum 30 supported on the inside of the needle slot 10 to keep the two opposite ends of the lifting bar 3, namely the top end 31 and the bottom end 32 in balance. By changing the position of the lifting bar 3 like a see-saw, the lifting bar 3 can be forced by the push jack 2 to lift the needle 6.

Figure 1:
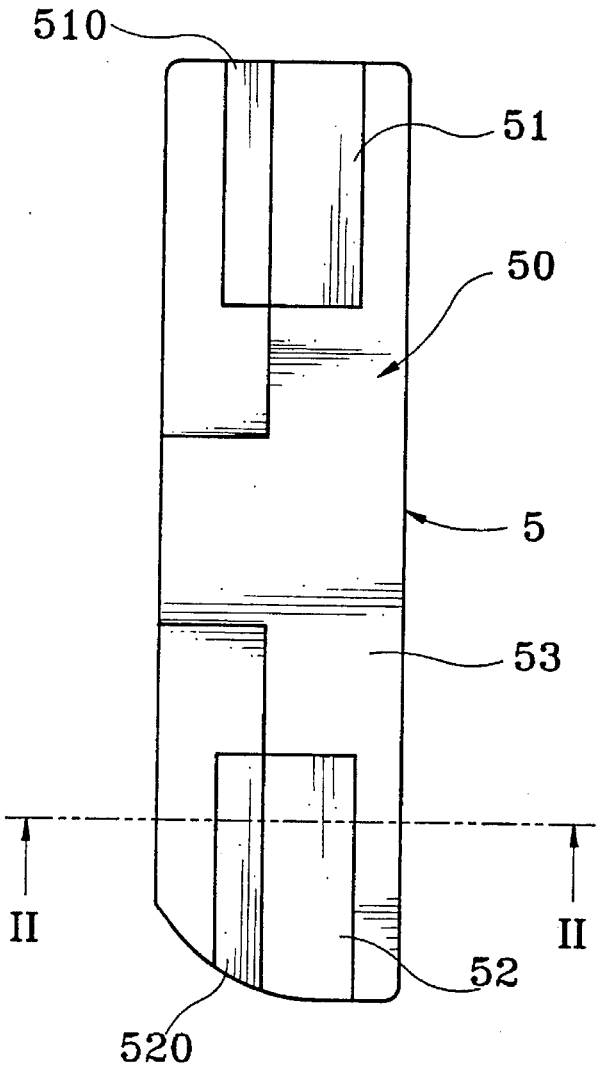
FIG. 1 is a front view of an electromagnetic device according to the present invention.
Figure 2:
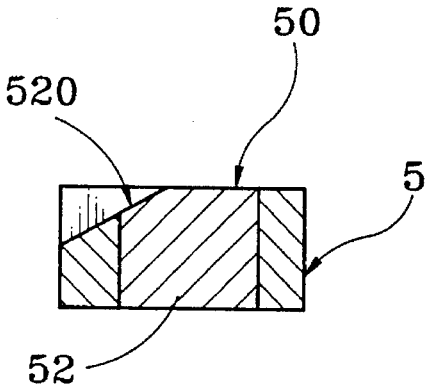
FIG. 2 is a cross sectional view of the electromagnetic device shown in FIG. 1.

Referring to FIGS. 1 and 2, the electromagnetic device 5 is mounted on the top needle pulling section 42 of the cam 4, and energized to change the position of the lifting bar 3. The electromagnetic device 5 has an acting face 50 facing outwards. When the cam 4 is rotated, the electromagnetic device 5 is moved over the outer end of each needle slot 10 of the knitting machine. Two electromagnets 51 and 52 are mounted on the acting face 50 at different elevations relative to the fulcrum 30 of the lifting bar 3. The acting face 50 has a plane 53 at one side of the longitudinal center in flush with the top needle pulling section 42 of the cam 4. The electromagnets 51 and 52 have a respective beveled surface 510 or 520. When the plane 53 passes through one needle slot 10, the lifting bar 3 in the respective needle slot 10 is supported on the plane 53 and will not be oscillated on the fulcrum 30.

Figure 4:
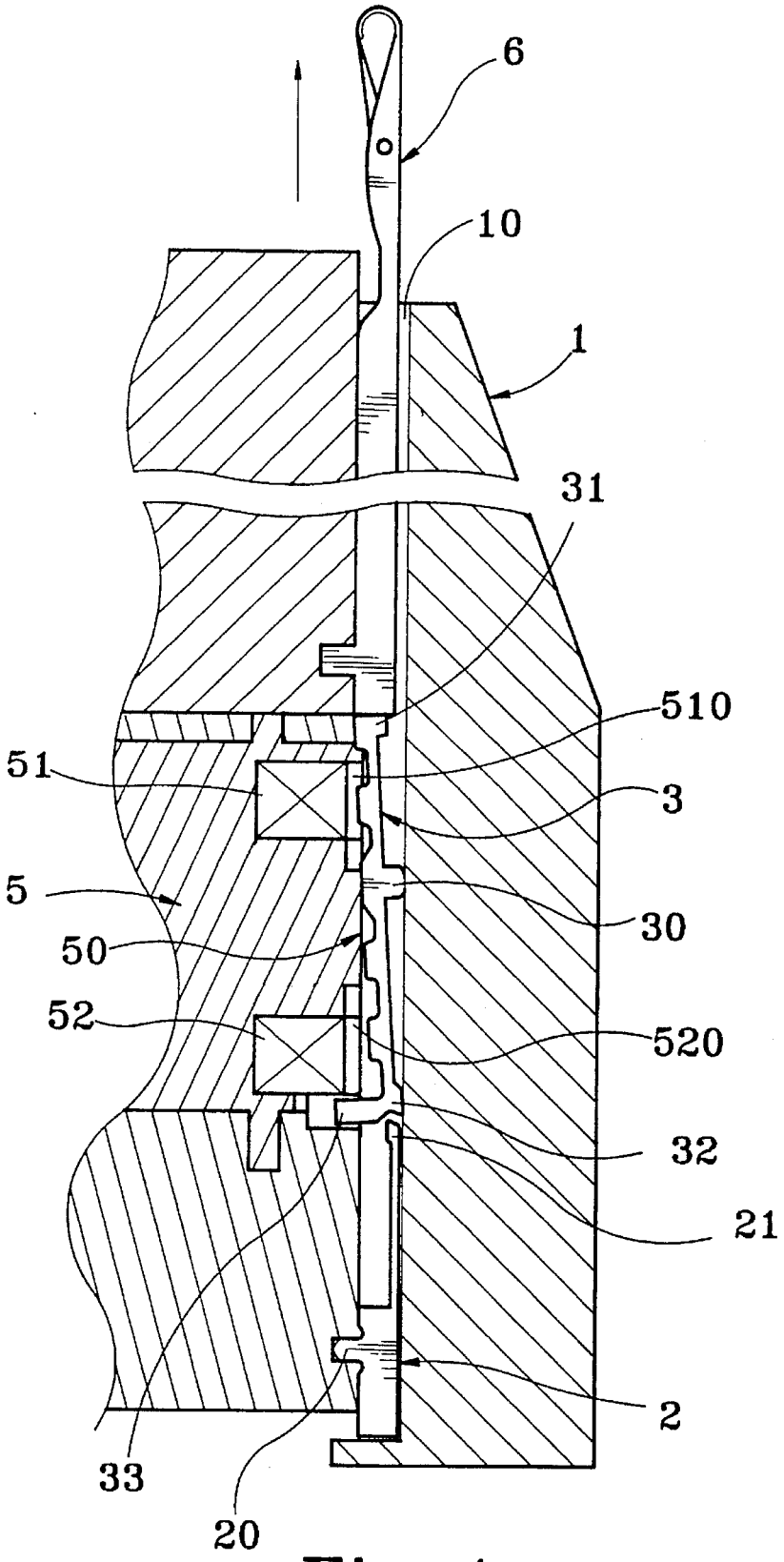
FIG. 4 is a sectional view along line IV—IV of FIG. 6.
Figure 5:
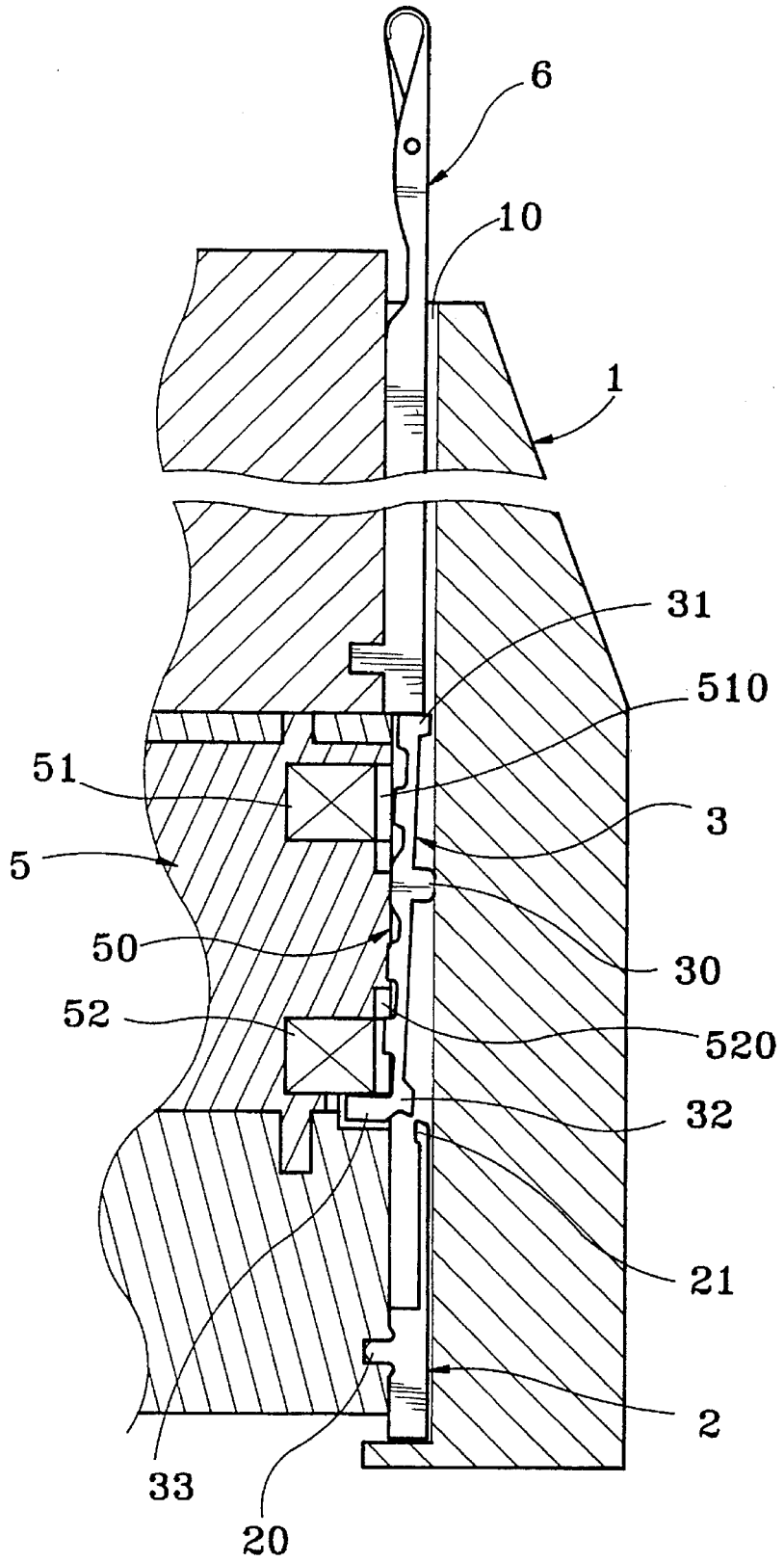
FIG. 5 is similar to FIG. 4 but showing the inactive position of the lifting bar.

When the electromagnet 51 is energized, the upper part of the lifting bar 3 is attracted, causing the top end 31 of the lifting bar 3 to be attached to the beveled surface 510 as shown in FIG. 4, and therefore the bottom end 32 of the lifting bar 3 is turned outwards and pushed by the push jack 2 to lift the respective needle 6. On the contrary, when the bottom end 32 of the lifting bar 3 is attracted by the beveled surface 520 of the electromagnet 52, the lifting bar 3 is turned to the position shown in FIG. 5, and the push jack 2 cannot push the lifting bar 3 during its up stroke, and therefore the respective needle 6 is not lifted.

If the butt 20 of the push jack 2 is moved along the curved top side of the bottom needle lifting section 40 when the bottom needle lifting section 40, the bottom needle pulling section 41, and the top needle pulling section 42 are vertically aligned, the butt 33 of the lifting bar 3 is moved along the horizontal bottom side of the top needle pulling section 42 without lifting the respective needle 6. The beveled surfaces 510 and 520 of the electromagnets 51 and 52 are vertically aligned with the needle lifting start end 400 of the bottom needle lifting section 40, therefore the butt 33 of the lifting bar 3 will be moved along the curved surface of the top needle pulling section 42 when the lifting bar 3 is lifted by the push jack 2, and the lifting bar 3 will be moved to the former horizontal position after each lifting stroke.

I claim:

1. A needle selection device comprising a plurality of push jacks respectively mounted in the needle slots of the needle cylinder of a circular knitting machine, a plurality of lifting bars respectively mounted in said needle slots and selectively driven by said push jacks to lift respective needles, and at least one electromagnetic device mounted on a cam of the circular knitting machine so as to pass from one lifting bar to another, wherein each lifting bar is centrally balanced in one needle slot on a fulcrum and moved between a first position in which the lifting bar is activated by the respective push jack to lift the respective needle, and a second position in which the lifting is idled; said at least one electromagnetic device comprises an acting face, and two electromagnets mounted on said acting face at different elevations relative to the fulcrum of said lifting bar, the acting face of said at least one electromagnetic device having a plane at one side disposed in flush with a top needle-pulling section of the cam of the circular knitting machine, said electromagnets having a respective beveled surface for attracting the lifting bar in each needle slot into said first position or said second position.

* * * * *